US005082393A

United States Patent [19]

Ringesten et al.

[11] Patent Number: 5,082,393

[45] Date of Patent: Jan. 21, 1992

[54] METHOD FOR FORMING ROAD AND GROUND CONSTRUCTIONS

[76] Inventors: Björn Ringesten, Box 113, Örkelljunga, Sweden, S-286 01; Olay Berge, P1 3003, Särö, Sweden, S-430 40; Leif Berntsson, Tågmästaregatan 10, Göteborg, Sweden, S-416 52

[21] Appl. No.: 435,448

[22] PCT Filed: May 29, 1987

[86] PCT No.: PCT/SE87/00264

§ 371 Date: Nov. 16, 1989

§ 102(e) Date: Nov. 16, 1989

[87] PCT Pub. No.: WO88/09412

PCT Pub. Date: Dec. 1, 1988

[51] Int. Cl.[5] ..... E01C 3/00

[52] U.S. Cl. ..... 404/28; 404/43; 404/134; 404/75

[58] Field of Search ..... 404/1, 17, 71, 85, 84, 404/101, 83, 90, 91, 134, 73, 28, 43, 31, 28; 52/1, 2, 80, 102, 79.1, 79.4, 74.5, 169.1; 405/135, 136, 258, 229; 14/1, 27, 28, 30; 116/DIG. 16

[56] References Cited

U.S. PATENT DOCUMENTS

| | | | |
|---|---|---|---|
| 394,583 | 12/1888 | Lee | 404/28 |
| 3,012,533 | 12/1961 | Tellefsen | 14/27 |
| 3,315,578 | 4/1967 | Wesch et al. | 404/73 |
| 3,479,786 | 11/1969 | Kreier | 52/745 |
| 3,589,250 | 6/1971 | Sedisatmo et al. | 404/17 |
| 3,626,702 | 12/1971 | Monahan | 404/28 |
| 3,673,750 | 7/1972 | Bokvist et al. | 52/745 |
| 3,804,543 | 4/1974 | Best | 405/258 |
| 4,318,361 | 3/1982 | Sluys | 14/27 |
| 4,531,859 | 7/1985 | Bettigole | 404/73 |
| 4,696,429 | 9/1987 | Ortwein | 404/71 |
| 4,856,930 | 8/1989 | Denning | 404/28 |

FOREIGN PATENT DOCUMENTS

| | | | |
|---|---|---|---|
| 1121530 | 1/1962 | Fed. Rep. of Germany | 404/17 |
| 2446664 | 5/1976 | Fed. Rep. of Germany | 404/17 |
| 100074 | 6/1962 | Norway | 404/17 |
| 670661 | 6/1979 | U.S.S.R. | 404/17 |
| 1384694 | 3/1988 | U.S.S.R. | 404/71 |

*Primary Examiner*—Ramon S. Britts
*Assistant Examiner*—Roger J. Schoeppel
*Attorney, Agent, or Firm*—Lerner, David, Littenberg, Krumholz & Mentlik

[57] ABSTRACT

A method for forming load-bearing road and ground constructions on a ground bed having a low load-bearing capacity includes assembling rigid support elements on the ground bed, forming a wearing layer above the support elements and disposing a light material having a bulk density lower than the ground bed below the support elements. The support elements are designed to be rigid so that point loads are distributed over the supporting surface of the ground bed. Before positioning the support elements, the ground bed is excavated to a predetermined depth such that the weight of the excavated ground mass in the area in which the support element is to be positioned corresponds essentially to the weight of the support element itself. By combining the heavier materials in the support elements and the light materials therebelow, the supporting structure is formed with a bulk density which does not exceed the average bulk density of the excavated ground mass so that the load exerted on the ground bed by the weight of the support structure and some of the dynamic loads absorbed by the support structure are compensated by the load reduction associated with the excavated ground mass. Any excess dynamic load exerted on the ground bed through the support structure is temporarily absorbed by the pore water pressure present in the ground bed.

13 Claims, 4 Drawing Sheets

METHOD FOR FORMING ROAD AND GROUND CONSTRUCTIONS

FIELD OF THE INVENTION

This invention relates to a method for forming the foundation of ground and road constructions on beds having a low carrying capacity such as clay, peat, mud and water.

BACKGROUND OF THE INVENTION

PRIOR ART

Road and ground constructions consist essentially of a wearing course disposed on the top, and, below it, a base course formed in varying thicknesses from a well-defined sand or gravel material. In cases where the ground layers have a particularly low carrying or load-bearing capacity, subbases can be added, these also being formed from a defined composition. A characteristic feature of conventional road and ground surfacings is that the base courses can only tolerate small tensile stresses. The function of the base course is essentially one of load distribution or, in other words, increasing the surface area influenced by the point loads which are exerted on the wearing course to an acceptable level. The tensile stresses which are formed in the base course are dissipated as friction in the underlying earthen mass.

Conventional road surfacings are made up of base courses and wearing courses whose bulk density is at least as great as that of the underlying ground. Consequently, road surfacings having considerably different bulk densities exist for various soil types. For example, well-graded, packed, sandy gravel has a bulk density of 1800–2000 kg/m$^3$; clay, 1500–1600 kg/m$^3$; and peat, 1000–1100 kg/m$^3$.

Bitumen stabilization is used to increase the tensile strength of base courses and, especially, the ability to withstand short-term loads. Various construction procedures including, for example, the use of fiber fabric mats, increase the tensile strength of both the base course and the underlying earthen mass. Cement or lime stabilization of the underlying ground, or the like, is primarily intended to increase rigidity. At the same time, the tensile strength also increases. Other measures for increasing the load-bearing capacity of the base courses and for transferring tensile stresses include laying out horizontal piles with end anchors or grillages of wood. Concrete, either plain or reinforced, is also used as a construction material. The concrete generally constitutes a wearing course, but also contributes to distributing point loads along the underlying ground layers. By virtue of the reinforcement, the tensile strength of the concrete is considerably improved. Even if the density of the concrete is 2300–2400 kg/m$^3$, the reduced thickness required for the base course results in a corresponding reduction in the intrinsic load exerted by the entire construction. Plastic-molded concrete tends to shrink over time, thereby causing uncontrollable crack formations to occur. Therefore, concrete surfacings are generally provided with joints intended to function as crack inhibitors. With such joints, the capacity of the wearing course to tolerate tensile stresses caused by bending moment is reduced. In order to prevent extensive settling due to such joints, the base course is typically chosen to be relatively thick, thereby increasing the load exerted by the entire construction. The load can be reduced to some extent by producing the wearing course from light ballast concrete. In the United States, for example, light ballast concrete with a density as low as 1600 kg/m$^3$ has been used with good results. Concretes having lower densities, however, have too little abrasion resistance and are quickly and easily worn down by traffic.

The load exerted on the underlying earthen masses can be reduced even further in several ways. Materials with low bulk density, such as slag, haydite and cellular plastic, have been used to reduce the weight of road embankments. Piles driven into the ground may also be used to transfer the load from the roadway down to deeper-lying earthen layers having a higher load-bearing capacity and rigidity than those lying above. The piles can be provided with pile helmets, or a reinforced, continuous concrete slab can be cast and supported by the piles. The base course and wearing courses are then formed above the slab. In this arrangement, the load-bearing capacity of the underlying earthen layers is not utilized, the construction being comparable to the absorption of all loads in the supports of a bridge. At the same time, loading and drainage of the ground results in a packing effect in which the porosity decreases, as does the pore water pressure. For ground having a low load-bearing capacity, the upper ground layers are often drained by a system of pipes, and a preliminary load is applied by the laying of subbase and base courses. Vertical drainage is also performed in order to shorten the consolidation time upon loading. In this way, any extensive settling of the ground occurs before the wearing course is applied. Such construction is typically provided with pipes for leading surface water away and for preventing a rise in ground water. In many cases where the ground is extremely inhomogeneous, the worst earthen masses are removed before pre-loading is applied. The ability to detect those areas which may result in particularly extensive settling is enhanced with pre-loading and simultaneous drainage.

Additional deformation in the form of so-called frost damage may also occur as the ground freezes. Such deformation may appear where frost protection material is located under road and ground constructions. The damage occurs when the ground water is conveyed in capillary fashion in fine-grained earth up to the freezing zone where an accumulation takes place and ice crystals are formed. Freezing occurs more easily when the surface construction is exposed, as with snow plowed roads having insulating snow banks along the sides thereof. The material in the roadway has little heat-insulating power so that the freezing is concentrated in the areas under the roadway itself. In order to prevent frost damage, the frost-susceptible material must be removed and the ground drained under the construction by pipe drainage. In order to improve the heat-insulating power of the roadway, insulating materials such as haydite and slag can be used.

The ability of a soil type to absorb loads with subsequent deformations depends on the particle size and distribution, the degree of compaction and the pore water pressure in the intermediate space between the soil particles. In loose soil types, such as clay and peat, the soil structure itself can only bear a load for which the soil layer has previously reached an equilibrium, i.e., the pre-consolidation pressure. When the load increases beyond this pressure, the excess load is initially absorbed by the pore water pressure in the soil layer. This pressure changes with time, the change depending on the permeability of the soil, otherwise known as the dewatering rate. As a certain volume of water is squeezed out of the soil, a corresponding deformation or settling in the ground layers occurs. This settling is irreversible.

The load-bearing capacity and rigidity of the earthen masses increase with increasing depth as overlying layers become compacted and dewatered over time. Thus, a so-called consolidation takes place. If a certain critical load is exceeded, the deformations increase quickly. When designing constructions on cohesive soils, either the load must be below this critical load, or the load must be transferred via piles down to soil layers having greater load-bearing capacity. Since ground layers are heterogeneous, the critical load tends to vary from place to place.

Since the surface of road and ground constructions lies above the adjacent ground to permit water runoff, loads exerted on these constructions are transferred to underlying ground layers. The pore water between the soil particles in the ground layers is drained off and remaining deformations appear. Settling in the ground layers is more pronounced with low pre-consolidation pressure. Such ground layers require, moreover, thicker base courses in order to increase the area influenced by the point loads exerted on the wear surfaces. This in turn results in greater overall loading on the ground layers and, hence, increased settling.

SUMMARY OF THE INVENTION

The present invention is based upon achieving improved load distribution in road and ground constructions by introducing increased rigidity in the upper part of such constructions. As a result, stresses and deformations in the subsoil are reduced. Moreover, the pore water pressure is used to absorb short-term loads having a concentrated load distribution, such as dynamic loads, which are exerted on the construction. The constructions are adapted and designed in such a way that a completely compensated foundation is provided. By designing the constructions to be relatively light, the foundation does not apply any additional load to the underlying soil layers than that which had been applied by the excavated surface soil and therefore does not change the pore water pressure in such underlying soil layers. In this connection, drainage of the ground layers as a result of overload is avoided, as is the accompanying settling in the subsoil, particularly with respect to short-term loads. Moreover, high ground water levels are no longer a disadvantage.

The supporting construction is formed from a composite of floating bodies including a continuous beam grid whose rigidity and load-bearing capacity are adapted to the properties of the ground, the magnitude of the load to be applied and the load-bearing capacity of the floating bodies, each of the bodies resting on, but not anchored to, the ground bed. Point load stresses are balanced out and stress concentrations are reduced by means of the rigidity of the construction and by means of dispersing the load via the floating bodies to the ground layers. In addition, the constructions are designed to be heat-insulating to prevent the underlying ground from freezing, thereby reducing frost damage.

The road and ground constructions of the present invention are made up of prefabricated foundation elements for assembly on site. The elements may be chosen to accommodate either the full width of the construction or parts thereof. The lower portion of the elements are formed from cellular plastic or an equivalent material which, during casting, forms shaped recesses for the beam grid which is intended to form the upper part of the element. More precisely, the construction of the present invention is accomplished by excavating earthen mass from the ground to form a ground bed and positioning a plurality of rigid foundation elements in edgewise fashion on the ground bed so that each one of the plurality of foundation elements is separated from an adjacent one of the plurality of foundation elements by a predetermined space. The earthen mass is excavated to a predetermined depth so that the total weight of the foundation element positioned on a portion of the ground bed is substantially equal to the total weight of the earthen mass excavated to form that portion of the ground bed. Each of the foundation elements includes a plurality of longitudinal and transverse beam members arranged to form a beam grid, a low density material disposed between the beam members and a slab-like member disposed above the beam grid. Although the beam members and the slab-like members are formed from a heavier material, the combination of these members with the low density material is such that the bulk density of the foundation element is no greater than the average bulk density of the excavated earthen mass.

After positioning, a material is deposited over the plurality of foundation elements wherein the deposited material fills the predetermined spaces to join adjacent ones of the foundation elements and wherein the deposited material forms a wearing layer above the plurality of foundation elements.

In one embodiment, the beam grid is formed from a reinforced light ballast concrete having a bulk density of between about 800 kg/m$^3$ and about 1400 kg/$^3$.

In another embodiment, the wearing layer comprises a cast concrete layer having a thickness between about 20 mm and about 60 mm, and a compression strength between about 50 MPa and about 300 MPa, preferably between about 60 MPa and about 150 MPa. In more preferred embodiments, the cast concrete layer includes a reinforcing grid formed from a material selected from the group consisting of steel, glass, carbon and polymers.

In still more preferred embodiments, the low density material comprises a cellular plastic having a low water absorption. Preferably, the cellular plastic is provided in the form of solid blocks. Alternatively, the cellular plastic may be provided in a granular form. The cellular plastic preferably has a bulk density of between about 10 kg/m$^3$ and about 500 kg/m$^3$ and more preferably between about 20 kg/m$^3$ and about 100 kg/m$^3$.

In still more preferred embodiments, the pore water pressure extant in the ground after construction of the road or ground construction is substantially equal to the pre-excavation pore water pressure.

Preferred methods in accordance with the present invention provide road or ground constructions wherein the load exerted on the ground bed by the weight of the foundation elements and at least some of the dynamic loads exerted on the foundation elements are compensated by the weight reduction associated with the excavated earthen mass. Any excess dynamic load exerted on the foundation elements, and in particular any dynamic load which exceeds the elastic deformation range for the elements, is temporarily absorbed by the pore water pressure present in the ground bed.

DETAILED DESCRIPTION OF A PREFERRED EMBODIMENT

Figure 1:
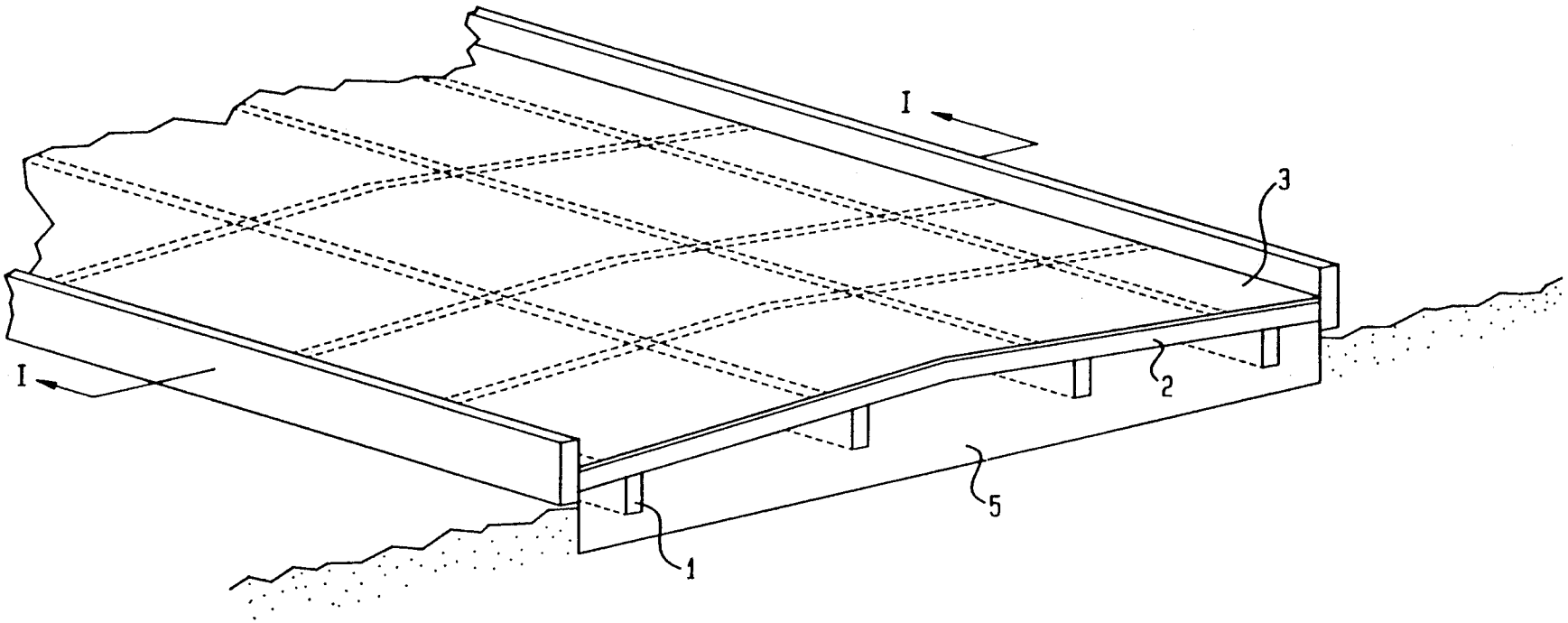
FIG. 1 is a perspective view showing a section of a road built in accordance with the present invention.
Figure 2:
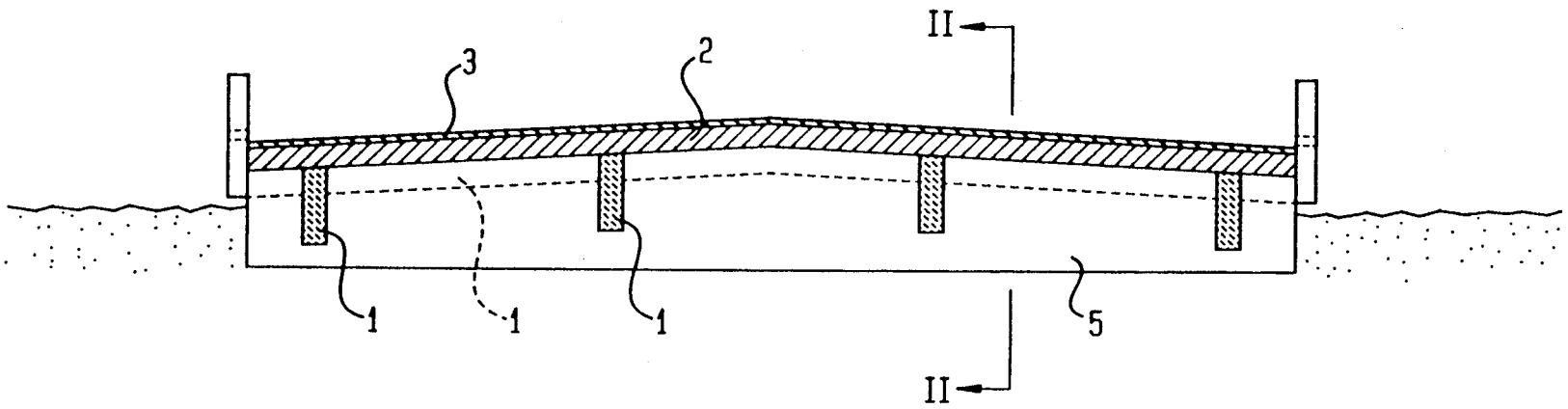
FIG. 2 is a cross-sectional view taken along line I—I of FIG. 1.
Figure 3:
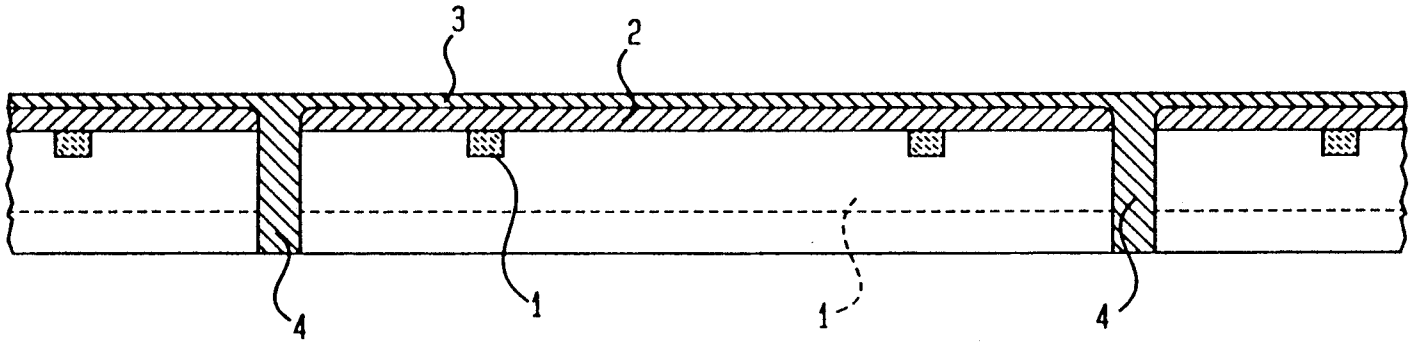
FIG. 3 is a partial longitudinal cross-sectional view taken along line II—II of FIG. 2.

The present invention is described hereinafter in connection with the elements used for forming the foundation of ground and road constructions. The concrete construction itself is designed as an assembly of longitudinal and transverse beams forming a beam grid 1 which is covered, on its upper edge, by a continuous concrete slab 2. The beam grid and the slab are reinforced so that the necessary rigidity and load-bearing capacity are obtained in the finished construction. The beams of beam grid 1 and the slab 2 are formed from light ballast concrete having a density of about 800–1400 kg/m$^3$ and a compression strength between about 5–25 MPa. Particularly suitable concretes are 3L concrete and X concrete, both of which are structurally light ballast concretes which have good frost resistance and provide good protection against reinforcement corrosion and which are, in both these respects, fully comparable to high quality normal concrete. However, since the abrasion resistance of these types of concretes is low, they are unsuitable for use in wearing courses.

Before positioning the support elements, consisting of beam grid 1 and slab 2, for forming the foundation of the construction, the surface layers of the ground must be excavated. Such excavation is preferably carried out where the weight of the excavated earthen mass will correspond to the magnitude of the load to be applied by the construction itself. The depth of the excavation is usually from several decimeters up to half a meter, if the height of the roadway is not determined by other considerations. The excavation can be carried out in a conventional manner without the need for support walls on the sides thereof. The ground does not have to be strengthened or drained, but only evened out with, for example, sand or gravel. Furthermore, base courses or subbase courses do not have to be added, and measures for preventing frost damage are also unnecessary.

When the support elements have been laid in place in the excavation by cranes or other lifting arrangements, the elements are locked in such a way that they can function as a base for positioning of subsequent elements or as a base for supporting the lifting arrangement. The height of the positioned elements should be adjustable as desired. Once set in place, a 20–60 mm thick reinforced concrete layer 3 is cast on top of the elements. The concrete for forming layer 3 is chosen to be of the high-strength type having compression strengths preferably in the range of 50–300 MPa, and more preferably in the range of 60–150 MPa. This concrete is used also for casting together the joints 4 between the elements. By reinforcing the cast layer with fiber nets of great anchoring capacity, the construction can be designed without joints in the top surface. Such fiber nets are typically formed from steel, glass, carbon or polymers. The shrinkage of the wearing layer leads to many fine cracks which are of no importance for either the functioning or the stability of the construction. It is also possible to use fibers and fiber mats, both of steel and of glass or polymer material. The high-strength concrete may be worked on the top surface to produce surface grooves which provide vehicles with enhanced gripping power. The groove design also enhances water runoff from the roadway. Damage to the roadway is easy to repair with the high-strength concrete.

The properties of the concrete used in the construction of the present invention are adapted so as to provide low intrinsic weight and, at the same time, maximum load-bearing capacity and rigidity. The high-strength concrete used for the wearing course functions as a compression zone within the areas in which the bending moments are at their greatest. The light ballast concrete is then situated in the tension zone and affects neither the moment capacity nor the rigidity. The high-strength concrete on the upper edge of the construction increases the punch resistance when this layer is compressed. The spaces between the beams of grid 1 are filled with a cellular plastic 5 or similar low density material which has a low water absorption, yet which has a sufficient rigidity and load-bearing capacity to absorb the deformations of the superstructure and disperse these to the underlying ground. Cellular plastics having a bulk density between about 10 kg/m$^3$ and about 500 kg/m$^3$ are preferred; bulk densities between about 20 kg/m$^3$ and 100 kg/m$^3$ are more preferred.

The load applied to the underlying ground can be made small in comparison to that applied by a conventional superstructure. In order achieve the desired load-bearing capacity of the road bed, dimensioning of the superstructure is based upon load transfer of wheel pressure from, for example, asphalt layers to the underlying ground according to theories of elasticity. Since the stress is a function of the quotient $E_1/E_2$, the greater the modulus of elasticity of an overlying layer ($E_1$), the less the stress and deformation of the underlying ground (having a modulus of elasticity of $E_2$).

Figure 4:
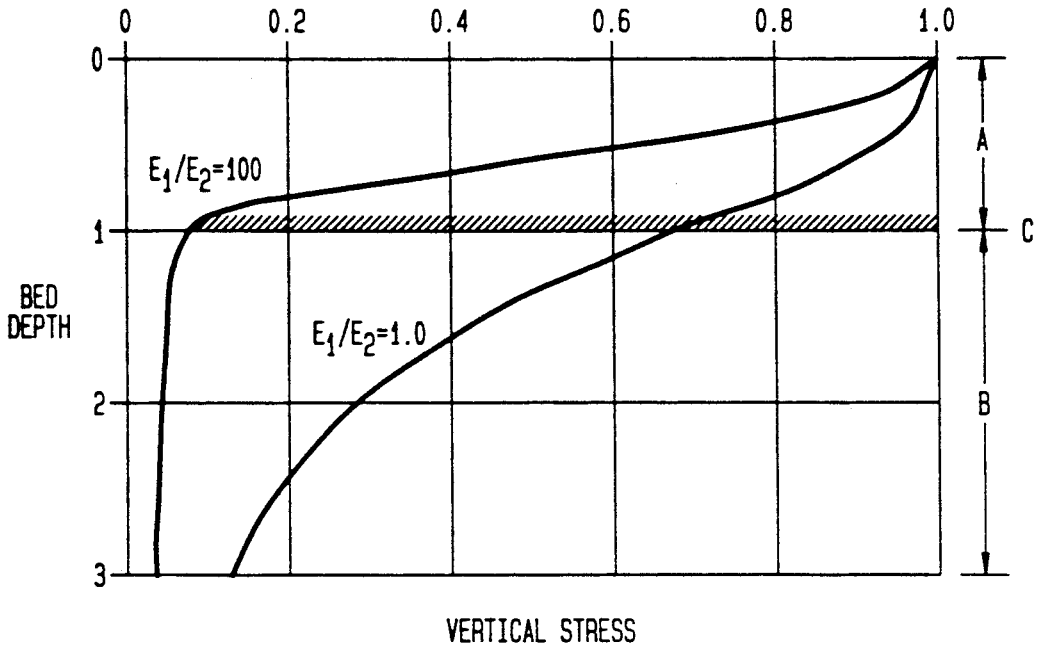
FIG. 4 is a graphical representation of the vertical stresses in an earthen bed.
Figure 5:
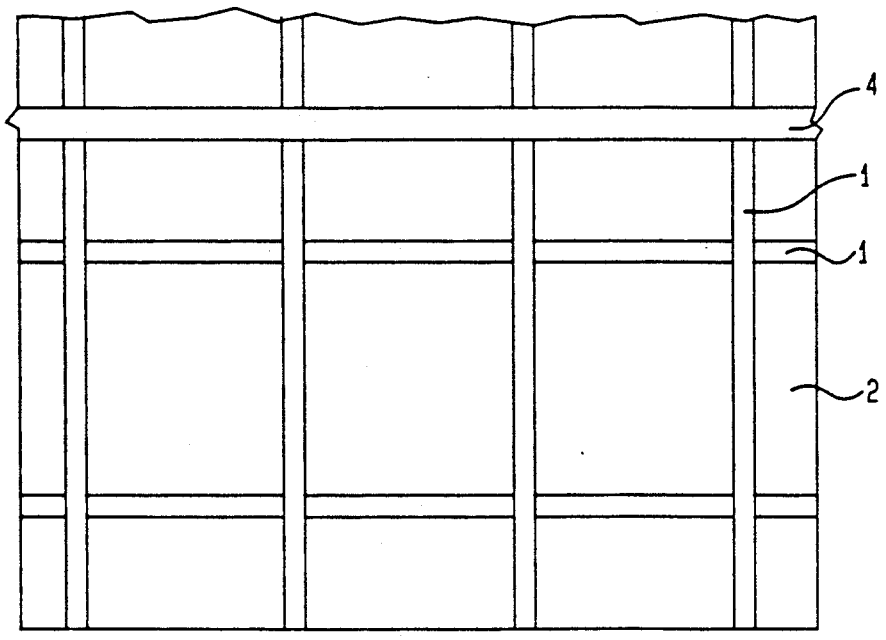
FIG. 5 is a bottom plan view of the construction element shown in FIG. 1, with the low density material removed to reveal the structure of the beam grid.

FIG. 4 shows the vertical stress, in a two-layer bed of varying depth, immediately under the load as a function of the quotient between the moduli of elasticity of the layers. The area designated "A" corresponds to the stress in the upper layer and the area designated "B" corresponds to the stress in the lower layer, while "C" indicates the boundary surface between the layers. The vertical stress is given along the x axis and the thickness of the layers is given along the y axis. The vertical stress in the upper layer of the two-layer bed can be read for various depths along the upper portion of each curve in area "A", while the vertical stress in the lower layer of the bed can be read for various depths along the lower portion of each curve in area "B".

The stress peaks from traffic load are dependent on irregularities in the roadway. In cases of superimposed stresses or a long load period, plastic deformation and a reduced modulus of elasticity can also occur which, over and above the breakdown of the surface, impair the function of the road bed. In conventional road constructions there are also local differences in the properties and thickness of the bed layers as a consequence of differences in material and shortcomings in the laying technique. The asphalt layer is fatigued with time by dynamic loads which therefore accelerates the breakdown process. The dimensioning criteria are, in principal, the same for the present invention. Breakage under wheel load is not a dimensioning criterion in this construction and therefore this type of pressure can, in principal, be increased. By employing a high-strength concrete layer in accordance with the present invention, the upper layer is formed with a high modulus of elasticity which does not change over time. Factors such as wearing, breakdown, handling and material inadequacies are of secondary importance, and the road and the construction acquire a good service index, i.e., a high PSI number.

Temperature fluctuations and gradients are considered when dimensioning the construction of the present invention. The stresses which develop from prevented deformation can be dissipated without the construction's function being impaired.

Loads from the road or ground construction are thus transferred to the ground, and the long-term loads exerted by the construction itself are essentially of the same magnitude as prevailed in the undisturbed earth. Point loads applied to the rigid superstructure are distributed such that the stress developed in the subsoil is below the critical value by a safe margin. In conventional road constructions the heavy intrinsic weight of the superstructure considerably reduces this safety margin.

Exceptional loads in the form of short-term loads which exceed the critical load or pre-consolidation pressure are absorbed by the pore water pressure which prevails in the ground soil. This characteristic of the ground soil is unaffected by dynamic load since the earth has low permeability for water flow.

The lower parts of the constructions which consist primarily of cellular plastic 5 or the like, are heat insulating, thereby eliminating damage due to frost. Further advantages resulting from the present invention are that the ground does not have to be drained and ditch drainage is avoided. The road follows the ground contour, and a leveling out on account of local differences is achieved.

What is claimed is:

1. A method for forming load-bearing road and ground constructions on ground having a low load-bearing capacity comprising the steps of:

excavating earthen mass from said ground to form a ground bed, positioning a plurality of rigid foundation elements having a first average bulk density in edgewise fashion on said ground bed, each of said foundation elements positioned on a corresponding portion of said ground bed, each one of said plurality of foundation elements separated from an adjacent one of said plurality of foundation elements by a predetermined space and including a plurality of longitudinal and transverse beam members arranged to form a beam grid, a low bulk density material disposed between said beam members and a slab-like member disposed above said beam grid, and depositing a material having a second average bulk density greater than said first average bulk density over said plurality of positioned foundation elements wherein said deposited material fills said predetermined spaces to join adjacent ones of said foundation elements and wherein said deposited material forms a wearing layer above said plurality of foundation elements, wherein the combination of said first and second bulk densities provides a total weight substantially equal to the total weight of a portion of said earthen mass excavated to form said corresponding portion of said ground bed.

2. A method as claimed in claim 1, wherein said beam grid is formed from a reinforced light ballast concrete having a bulk density of between about 800 $kg/m^3$ and about 1400 $kg/m^3$.

3. A method as claimed in claim 1, wherein said wearing layer comprises a cast concrete layer having a thickness between about 20 mm and about 60 mm.

4. A method as claimed in claim 3, wherein said cast concrete layer has a compression strength between about 50 MPa and about 300 MPa.

5. A method as claimed in claim 4, wherein said cast concrete layer has a compression strength between about 60 MPa and about 150 MPa.

6. A method as claimed in claim 3, wherein said cast concrete layer includes a reinforcing grid.

7. A method as claimed in claim 6, wherein said reinforcing grid is formed from a material selected from the group consisting of steel, glass, carbon and polymers.

8. A method as claimed in claim 1, wherein said low bulk density material comprises a cellular plastic having low water absorption.

9. A method as claimed in claim 8, wherein said cellular plastic is provided in the form of solid blocks.

10. A method as claimed in claim 8, wherein said cellular plastic is provided in a granular form.

11. A method as claimed in claim 8, wherein said cellular plastic has a bulk density of between about 10 $kg/m^3$ and about 500 $kg/m^3$.

12. A method as claimed in claim 11, wherein said cellular plastic has a bulk density of between about 20 $kg/m^3$ and about 100 $kg/m^3$.

13. A method as claimed in claim 1, wherein said ground has a pre-excavation pore water pressure and a post-construction pore water pressure, said post-construction pore water pressure at a specific depth and location being substantially equal to said pre-excavation pore water pressure at said specific depth and location.

* * * * *

UNITED STATES PATENT AND TRADEMARK OFFICE

CERTIFICATE OF CORRECTION

PATENT NO. : 5,082,393

DATED : January 21, 1992

INVENTOR(S) : Ringesten et al

It is certified that error appears in the above-identified patent and that said Letters Patent is hereby corrected as shown below:

On the title page under item [75] Inventors: line 2, "Olay" should read --Olav--.

Signed and Sealed this

Thirteenth Day of April, 1993

*Attest:*

STEPHEN G. KUNIN

*Attesting Officer*

*Acting Commissioner of Patents and Trademarks*